United States Patent [19]

Robinson et al.

[11] Patent Number: 4,858,826

[45] Date of Patent: Aug. 22, 1989

[54] COLORED FLAME WATER FOUNTAIN ILLUMINATION SYSTEM

[75] Inventors: Alan S. Robinson, El Monte; Mark W. Fuller, Studio City, both of Calif.

[73] Assignee: Wet Enterprises, Inc., Universal City, Calif.

[21] Appl. No.: 291,414

[22] Filed: Dec. 28, 1988

Related U.S. Application Data

[63] Continuation of Ser. No. 48,566, May 11, 1987, abandoned.

[51] Int. Cl.[4] ..... F21P 7/00

[52] U.S. Cl. ..... 239/18; 44/59

[58] Field of Search ..... 239/17, 18; 40/427; 44/59, 67–69; 431/126, 46, 67; 251/5

[56] References Cited

U.S. PATENT DOCUMENTS

| | | | |
|---|---|---|---|
| 2,270,442 | 1/1942 | Jares | 431/126 X |
| 3,215,186 | 11/1965 | Levitt | 431/126 |
| 3,683,887 | 8/1972 | Sammut | 431/67 X |
| 4,056,348 | 11/1977 | Wolfe | 431/67 X |
| 4,145,180 | 3/1979 | Bendorf | 431/46 |
| 4,249,884 | 2/1981 | Cade | 432/46 X |
| 4,304,545 | 12/1981 | Matthews | 431/46 X |
| 4,635,897 | 1/1987 | Gallant | 251/5 |

FOREIGN PATENT DOCUMENTS

| | | | |
|---|---|---|---|
| 19351 | 7/1970 | Japan | 239/18 |

*Primary Examiner*—Andres Kashnikow
*Assistant Examiner*—Patrick N. Burkhart
*Attorney, Agent, or Firm*—Blakely, Sokoloff, Taylor & Zafman

[57] ABSTRACT

The invention consists of a colored flame system for illuminating water fountains. A burner assembly, comprising a main burner, a pilot burner, an igniter, a flame sensor and multiple colorant nozzles is located adjacent to one or more water nozzles of the fountain. A control unit oversees operation of the system. Upon commands from an operator, the control unit causes the pilot and main burners to light and injects the desired colorants into the main burner flame. The colorants are concentrated solutions of metallic salts. The flame sensor acts as a safety device insuring that gas and colorants are emitted only when the pilot and main burners are lit.

11 Claims, 3 Drawing Sheets

COLORED FLAME WATER FOUNTAIN ILLUMINATION SYSTEM7

This is a continuation of application Ser. No. 07/048,566 filed 5-11-87, now abandoned.

BACKGROUND

1. Field of The Invention

The present invention relates to the field of water fountains and, more specifically, to a water fountain incorporating colored flames as a means of illumination.

2. Prior Art

Water fountains have long been treasured for their decorative and entertaining qualities. Fountains range in size and complexity from small fountains with single streams of water, to large outdoor fountains incorporating sophisticated light displays. Such large fountains are typically installed in hotels, shopping malls, museums and parks. A whole new art form has developed in which the movement of water in a fountain is choreographed to music. Often electric lights are used for illumination, making nighttime performances of such fountains particularly impressive. By using multiple, differently colored lights, a particularly entertaining interplay between water, light and music can be rested.

In addition to electric lights, gas burners have also been used to illuminate water fountains. While the resulting interplay of fire and water has added a new dimension to water fountain displays, heretofore water fountain flame illumination systems have been able to produce flames of only a single color.

The present invention, however, produces flames for the illumination of water fountain displays, the color of which can be changed at will. By adding the versatility of color to flame illuminated water fountain displays, the present invention makes possible even more attractive and entertaining water fountain displays than were possible with the prior art.

SUMMARY OF THE INVENTION

The invention consists of apparatus and a method for producing colored flames for the illumination of water fountain displays. The invention comprises a main burner nozzle attached to a fuel supply and mounted in proximity with one or more of the water nozzles of a water fountain display. A pilot burner and a glow plug or spark discharge igniter are located adjacent to the main burner nozzle, as are a number of flame colorant nozzles. To produce a colored flame, a stream of colorant, preferably consisting of a concentrated solution of metallic salts, is forced under pressure through a colorant nozzle. As the atomized stream of colorant impinges on the main burner flame, the metallic salts are ionized, producing a colored flame. The invention also includes a flame sensor located adjacent to the pilot and main burners. During the operation of the fountain, the flame sensor detects the presence or absence of a flame and is used as a safety device to insure that the flow of fuel to the burners is cut off if the pilot and main burner flames suddenly die. A central control panel oversees the operation of the colored flame system.

DETAILED DESCRIPTION OF THE INVENTION

A colored flame illumination system for water fountain displays is disclosed. In the following description, for purposes of explanation, numerous details are set forth, such as specific materials, arrangements and proportions in order to provide a thorough understanding of the present invention. However, it will be apparent to one skilled in the art that the invention may be practiced without these specific details. In other instances, well-known electrical and piping system components, such as UV sensors, check valves and solenoid valves, have not been described in detail in order not to obscure the present invention unnecessarily. In the following discussion, the same numbers are used to designate like elements throughout the drawings.

The invention comprises three main components: a burner assembly; a colorant reservoir assembly; and a control unit.

Figure 1:
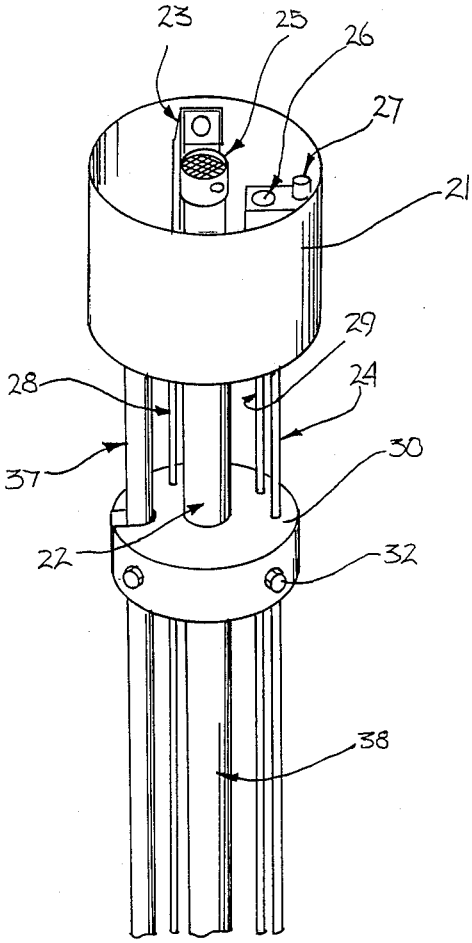
FIG. 1 is a perspective view of the main burner assembly illustrating the arrangement of the various elements of the invention.
Figure 2:
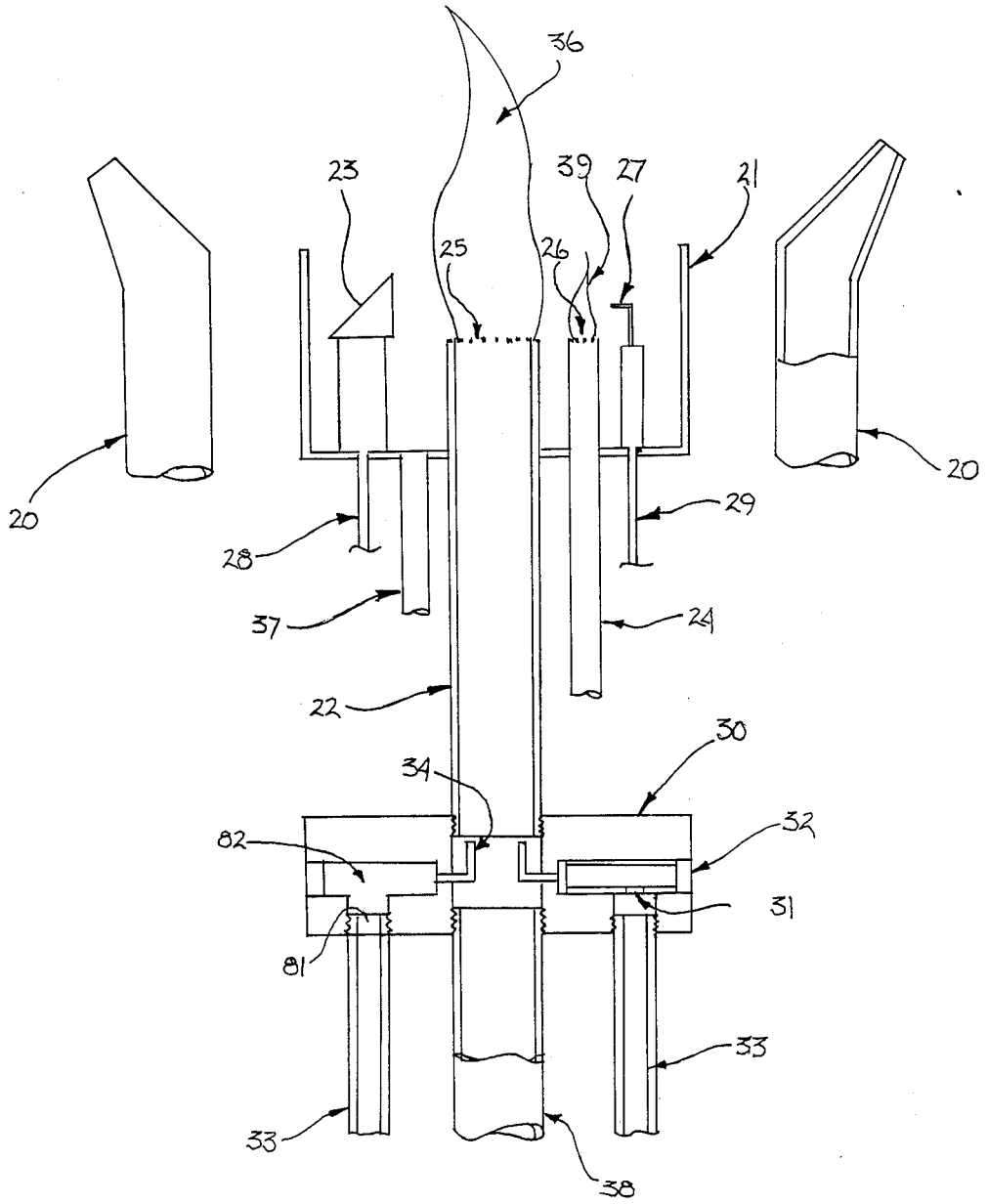
FIG. 2 is a sectional view of the main burner assembly.

FIGS. 1 and 2 are illustrations of the burner assembly. The major structual elements of the burner assembly are burner cup 21, a main fuel line comprised by pipe segments 22 and 38, for supplying a fuel such as gas and colorant nozzle mounting block 30. The burner cup is mounted such that its open side faces vertically upwards, and it is generally located adjacent to one or more water nozzles 20 of a water fountain. The burner cup may be situated above the water level of the fountain, or may be recessed in a well or pipe such that it is flush or slightly below the surface of the surrounding water. Pipe segment 22 protrudes vertically through the bottom of the burner cup, generally in a central location. The open top of the pipe segment 22 is provided with a wire mesh atomizing screen 25 that assists in the atomization of colorants prior to their impinging on the main burner flame 36. The colorant nozzle mounting block 30 is located adjacent to and below the burner cup. Nozzle mounting block 30 contains a central hole 35, threaded at each end to accept the pipe segments 22 and 38 of the main fuel line. The bottom side of the nozzle mounting block also contains threaded holes for accepting the top threaded ends of the colorant lines 33. Colorant nozzles 34 project into central hole 35. Internal passages 31 are provided to allow colorant to pass from each colorant line 33 to its corresponding nozzle 34. In the preferred embodiment, passages 31 are formed by drilling a first hole 81 vertically upward from the bottom of block 30, and a second hole 82 radially inward from the side of block 30, such that the second hole 82 intersects both the first hole 81 and the central hole 35 of mounting block 30. A colorant nozzle 34 is mounted in the end of a hollow cylindrical insert 83 that is slid into the second hole. The insert has a hole 84 through its side located in a position corresponding to the first vertical hole 81 in the mounting block. After the insert and the nozzle have been inserted into the mounting block, a plug 32 is used to seal off the outside end of the second hole 82, and a colorant line 33 is threaded into the bottom end of the first hole 81. Nozzle mounting block 30 comprises a nozzle 34, internal passage 31 and colorant line 33 for each colorant used. In the preferred embodiment, the number of colorants is four. Nozzle mounting block 30 may also contain passages for the various pipes and wires leading to the burner cup, or those pipes and lines may pass around the outside of the block.

Burner cup 21 is also fitted with a drain 37 and an ignition means for lighting the main burner flame. In the preferred embodiment, this ignition means comprises a pilot burner 26 attached to pilot fuel line 24, together with a glow plug 27. The glow plug is used to ignite the pilot flame 39, and the pilot flame in turn lights the main flame 36. Burner cup 21 may also include an optical flame sensor 23. Sensor 23 is typically a UV light sensor. It senses when the pilot or the main burner is lit and is used as part of a safety mechanism that prevents the flow of fuel to the main or pilot burners when the main and pilot flames have been extinguished.

Figure 3:
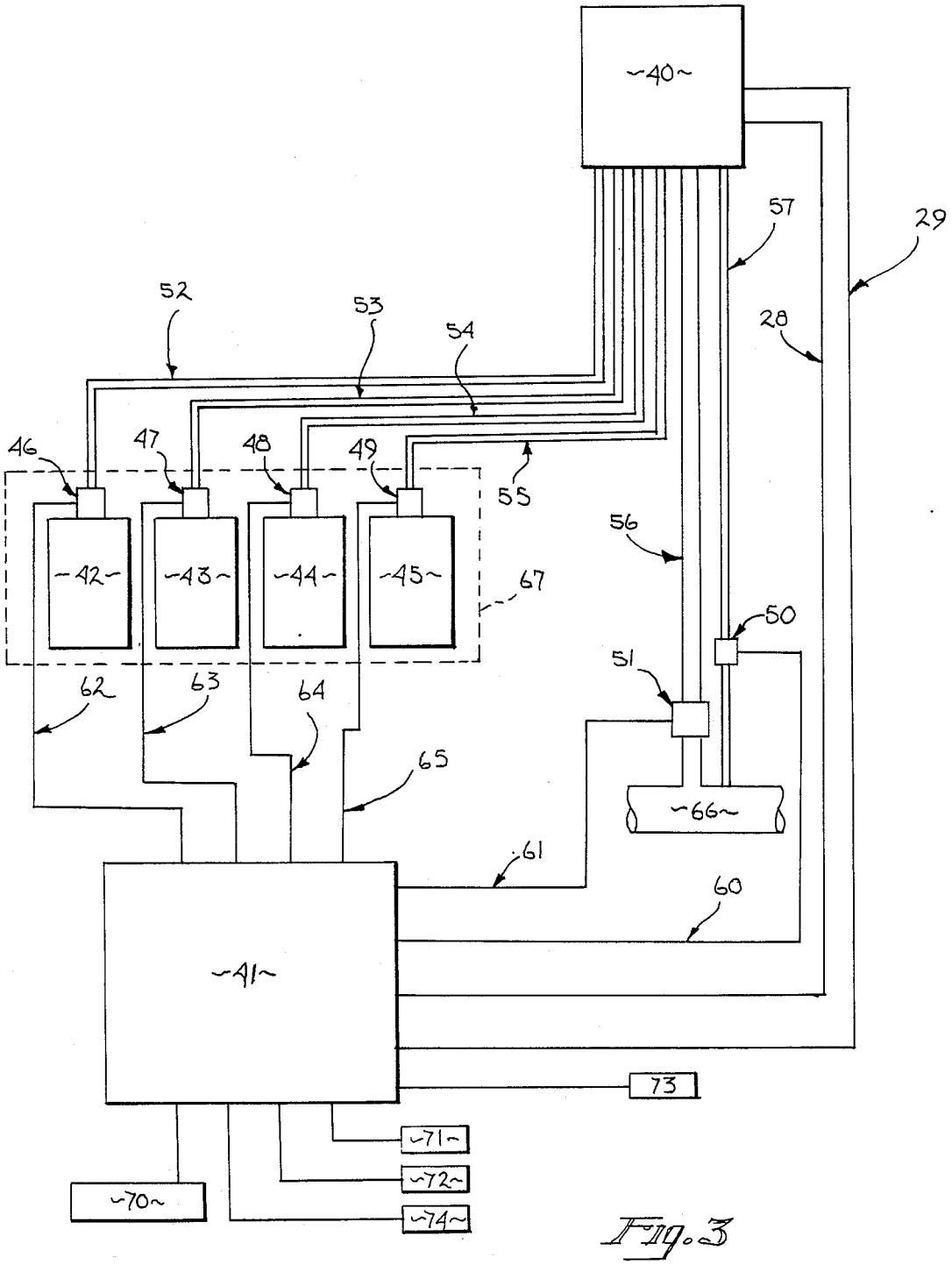
FIG. 3 is a schematic view illustrating the interconnections of fuel lines, colorant lines and electrical control lines between the major components of the invention.

Turning now to FIG. 3, this Figure is a schematic showing the layout of the various components of the invention. In addition to the burner assembly 40, the main elements of the invention are a control unit 41, and a colorant reservoir assembly indicated generally by number 67. The colorant reservoir assembly 67 consists of tanks or other vessels for holding a quantity of each colorant, indicated by numbers 42 through 45, together with a pump and valve assembly, 46 through 49, for each colorant. Colorant lines 52 through 55 connect each colorant reservoir with its corresponding colorant nozzle contained in burner assembly 40. The main fuel line 56 and the pilot fuel line 57 connect the main burner and the pilot burner located in the main burner assembly 40 with fuel supply line 66. Fuel control valves 50 and 51 are inserted in the main fuel line and the pilot fuel line between the main burner assembly and fuel supply line 66. Main fuel control valve 51 and pilot fuel control valve 50 are connected to control unit 41 by means of electrical control lines 61 and 60, respectively. Electrical control line 28 connects control unit 41 with the flame sensor 23, and electrical control line 29 connects the control unit with the glow plug 27.

Fuel control valves 51 and 50 are electrically operated solenoid valves, or any other electrically, hydraulically, or pneumatically operated valves. Pump and valve assemblies 46 through 49 are devices or combinations of devices that, upon command by the control unit, are capable of delivering colorant from the colorant reservoirs to the colorant nozzles under pressure. In the preferred embodiment, the colorants consist of concentrated metallic salt solutions that must be delivered to the colorant nozzle at a pressure between 60 and 100 PSI. Such pressures are necessary to insure that the liquid colorant is atomized finely enough by passage through the colorant nozzles such that the metallic salts in solution are ionized when they contact the burner flame. In the preferred embodiment, pump and valve assemblies 46 through 49 comprise conventional pneumatically operated pinch valves mounted in series with inlet and outlet check valves. A pinch valve consists basically of a flexible hose surrounded by a collar or envelope into which pressurized air can be introduced. When air is introduced in the envelope, the tube is pinched, and any liquid contained in the tube is squeezed out. The inlet and outlet check valves insure that the liquid flows in one direction only.

Control unit 41 is connected to several operator controls. These may include an emergency stop button 71, a start up switch 72, a safety switch 73, a dead man switch 74, and a color control 70. In the preferred embodiment, control unit 41 comprises a microprocessor that is programmed to control various modes of operation of the flame burner system. The first such mode of operation is the pilot ignition sequence. Engaging the start up switch 72 initiates the ignition sequence. During the ignition sequence, the control unit first activates the glow plug 27 for about 30 seconds to allow it to reach a temperature sufficient to ignite the pilot burner 26. After 30 seconds, the control unit opens pilot control valve 50 for 10 seconds. If, at the end of the 10 seconds, the flame sensor 25 senses that the pilot flame 39 has been lit, the control unit 41 signals main fuel control valve 51 to open. The main burner flame 36 is then ignited by the pilot flame 39.

If, at the end of 10 seconds the flame sensor 25 does not see a pilot flame, the ignition sequence is repeated. If after a second 10 second period, the pilot flame still remains unlit, control unit 41 shuts down the system. Once this shutdown occurs, the flame system can only be restarted upon the manual resetting of safety switch 73

Once the main flame 36 is lit, colorant can be added in response to inputs from the colorant control 70.

Each colorant produces a differently colored flame. In the preferred embodiment, the colors produced are blue, green, orange and red. If, for example, colorant control 70 indicates that a red flame is desired, the control unit 41 first checks to see whether the main burner flame 36 is lit and, if it is, sends a signal to the pump and valve assembly for the red colorant. It will be recalled that in the preferred embodiment this pump and valve assembly comprises a pinch valve and two check valves. This signal from the control unit 41 opens a solenoid valve controlling the introduction of pressurized air into the pinch valve. The pressurized air causes the volume of fluid contained within the tube of the pinch valve to be pumped up and out of the red colorant nozzle causing the flame to turn red. If an additional amount of red colorant is desired, control unit 41 sends a second signal to the pinch valve, causing the pressurized air to be released. The cycle can then begin again.

In addition to shutting down the system when the pilot valve refuses to light for two consecutive ignition sequences, the control unit 41 will shut down the system, thereby shutting off the flow of fuel to the main and pilot burners, if the emergency switch 71 is pushed or a dead man switch 74 is released. The safety of the operation of the color flame system is thereby assured.

Accordingly, a system for using colored flames to illuminate water fountains has been disclosed. The invention allows the creation of aesthetically pleasing and entertaining water and light show displays that was not possible in the prior art. Although specific details are described herein, it will be understood that various changes can be made in the materials, details, arrangements and proportions of the various elements of the present invention without departing from the scope of the invention. For example, although this specification refers mainly to liquid colorants, gaseous colorants may also be used. In addition, the specific arrangement of the pilot and main burners, the colorant nozzles and the flame sensor may be varied. The location of the burner assembly with respect to water nozzles of the fountain may also be changed. Any number of colorant nozzles may be used, and more than one burner may be incorporated in a single burner cup. Other variations will be apparent to those skilled in the art.

We claim:

1. An improved apparatus for illuminating a water fountain, said water fountain comprising at least one water nozzle capable of emitting a stream of water, said apparatus comprising:

a main burner assembly disposed adjacent to said water nozzle and disposed partially beneath a surface of water in said fountain;

a colorant manifold assembly connected to said main burner assembly by a plurality of colorant lines; and a control unit connected to said main burner assembly and said colorant manifold assembly by a plurality of electrical control wires;

said main burner assembly comprising;

a main burner cup, said main burner cup fitted with a drain for eliminating any water that enters said main burner cup;

a main burner nozzle disposed generally in the center of said main burner cup;

a pilot burner nozzle disposed adjacent to said main burner nozzle;

a main fuel line connecting said main burner nozzle to a fuel supply, said main fuel line fitted with a main fuel flow control means for controlling the amount of fuel flowing through said main fuel line;

a pilot fuel line connecting said pilot burner nozzle with said fuel supply, said pilot fuel line fitted with a pilot fuel flow control means for controlling the amount of fuel flowing through said pilot fuel line;

an ignition means disposed adjacent to said pilot burner nozzle;

a predetermined number of colorant nozzles disposed adjacent to said main burner nozzle;

a flame sensor disposed adjacent to said main and pilot burner nozzles and connected by a flame sensor control line to said control unit, said flame sensor sending a signal to said control unit whenever at least one of said pilot or main burner flame is lit;

said colorant manifold assembly comprising:

a predetermined number of colorant reservoirs, each of said colorant reservoirs being connected to one of said colorant nozzles by a colorant line; and a colorant flow control means for each of said colorant line for controlling the amount of colorant flowing through said colorant lines;

said control unit comprising:

electrical control lines connected to each of said main fuel flow control means, said pilot fuel flow control means, said colorant flow control means, and said ignition means; and a plurality of switching means whereby each of the said flow control and ignition means can be selectively activated and controlled, such that:

fuel emitted from said pilot burner nozzle can be ignited by said ignition means, creating a pilot burner flame; and fuel emitted from said main burner nozzle can be ignited by said pilot burner flame creating a main burner flame; and colorant emitted from said colorant nozzles can impinge on said main burner flame causing the color of said main burner flame to change according to which of such colorants, singly or in combination, is emitted from said colorant nozzles;

said control unit comprising a microprocessor, said control unit controlling said main fuel flow control means such that fuel is emitted from said main burner nozzle only when said flame sensor senses that said pilot burner flame is lit;

said control unit controlling said pilot fuel flow control means such that fuel is prevented from emitting from said pilot burner nozzle whenever said flame sensor has not detected a pilot flame for a predetermined period of time; and said control unit controlling said colorant flow control means such that colorant is emitted from said colorant nozzles only when said flame sensor senses that at least one of said pilot or main burner flames are lit.

2. The apparatus of claim 1 in which said main burner assembly comprises, in addition, a flame sensor disposed adjacent to said main and pilot burner nozzles and connected by a flame sensor control line to said control unit, said flame sensor sending a signal to said control unit whenever at least one of said pilot or main burner flame is lit.

3. The apparatus of claim 1 in which said control unit comprises a microprocessor.

4. The apparatus of claim 1 in which said colorant comprise liquid solutions of metallic salts.

5. The apparatus of claim 1 in which said colorant flow control means comprise pneumatically operated pinch valves.

6. The apparatus of claim 1 in which said main burner assembly comprises a colorant nozzle mounting block disposed adjacent to said main burner cup, said colorant nozzles being mounted in said colorant mounting block.

7. The apparatus of claim 1 in which said number of said colorants is four.

8. The apparatus of claim 1 in which said ignition means is a glow plug.

9. The apparatus of claim 1 in which said fuel is a gas.

10. An improved apparatus for illuminating a water fountain, said water fountain comprising at least one water nozzle capable of emitting a stream of water, said apparatus comprising:

a main burner disposed adjacent to said water nozzle and disposed partially beneath a surface of water in said fountain;

a flame sensor disposed to adjacent to said main and pilot burner nozzles and connected by a flame sensor control line to said control means, said flame sensor sending a signal to control means when ever said main burner flame is lit;

a control means for regulating the flow of said fuel to said main burner, the flow of said control to said main burner flame, and for controlling the operation of said ignition means;

said control means controlling said fuel flow such that fuel is emitted from said main burner nozzle only when said flame sensor senses that said ignition means is operating;

said control means controlling said colorant flow control means such that colorant is emitted from said colorant nozzle means only when said flame sensor senses that said main burner flame is lit;

whereby a colored flame is created for the improved illumination of a water fountain.

11. An improved apparatus for illuminating a water fountain, said water fountain comprising at least one water nozzle capable of emitting a stream of water, said apparatus comprising:

a main burner assembly disposed adjacent to said water nozzle and disposed partially beneath a surface of water in said fountain;

a colorant manifold assembly connected to said main burner assembly by a plurality of colorant lines; and a control unit connected to said main burner assembly and said control manifold assembly by a plurality of electrical control wires;

said main burner cup fitted with a drain for eliminating any water that enters said main burner cup;

a pilot burner nozzle disposed adjacent to said main burner nozzle;

a main fuel line connecting said main burner nozzle to a fuel supply, said main fuel line fitted with a main fuel flow control means for controlling the amount of fuel flowing through said main fuel line;

a pilot fuel line connecting said pilot burner nozzle with said fuel supply, said pilot fuel line fitted with a pilot fuel flow control means for controlling the amount of fuel flowing through said pilot fuel line;

an ignition means disposed adjacent to said pilot burner nozzle;

a predetermined number of colorant nozzles disposed adjacent to said main burner nozzle;

said colorant manifold assembly comprising;

a predetermined number of colorant reservoirs, each of said colorant reservoirs being connected to one of said colorant nozzles by a colorant line; and a colorant flow control line means for each of said colorant lines for controlling the amount of colorant flowing through said colorant lines;

said colorant unit comprising:

electrical control lines connected to each of said main fuel flow control means, said pilot fuel flow control means, said colorant flow control means, and said ignition means; and a plurality of switching means whereby each of the said flow control and ignition means can be selectively activated and controlled, such that:

fuel emitted from said pilot burner nozzle can be ignited by said ignition means, creating a pilot burner flame;

fuel emitted from said main burner nozzle an be ignited by said pilot burner flame creating a main burner flame; and colorant emitted from said colorant nozzles can impinge on said main burner flame causing the color of said main burner flame to change according to which of such colorants, singly or in combination, is emitted from said colorant nozzles;

a flame sensor disposed to adjacent to said main and pilot burner nozzles and connected by a flame sensor control line to said control unit, said flame sensor sending a signal to control unit when ever at least one of said pilot or main burner flame is lit;

said control unit controlling said fuel flow such that fuel is emitted from said main burner nozzle only when said flame sensor senses that said pilot burner flame is lit;

said control unit controlling said pilot fuel flow control means such that fuel is prevented from emitting from said pilot burner nozzle whenever said flame sensor has not detected a pilot flame for a predetermined period of time; and said control unit controlling said colorant flow control means such that colorant is emitted from said colorant nozzle means only when said flame sensor senses that at least one of said pilot or main burner flames are lit.

* * * * *